US009207033B2

(12) United States Patent
Vais

(10) Patent No.: US 9,207,033 B2
(45) Date of Patent: Dec. 8, 2015

(54) FIREARM SUPPRESSOR BAFFLE

(71) Applicant: George Vais, Thassos (GR)

(72) Inventor: George Vais, Thassos (GR)

(73) Assignee: George Vais, Thassos (GR)

( * ) Notice: Subject to any disclaimer, the term of this patent is extended or adjusted under 35 U.S.C. 154(b) by 0 days.

(21) Appl. No.: 14/230,226

(22) Filed: Mar. 31, 2014

(65) Prior Publication Data

US 2015/0276340 A1 Oct. 1, 2015

(51) Int. Cl.
*F41A 21/00* (2006.01)
*F41A 21/30* (2006.01)

(52) U.S. Cl.
CPC ..... *F41A 21/30* (2013.01)

(58) Field of Classification Search
CPC ..... F41A 21/30
USPC ..... 181/223; 89/14.2, 14.4
See application file for complete search history.

(56) References Cited

U.S. PATENT DOCUMENTS

| | | | | |
|---|---|---|---|---|
| 958,934 | A * | 5/1910 | Maxim | 181/223 |
| 1,770,471 | A | 7/1930 | Hatcher | |
| 1,821,688 | A | 9/1931 | Bourne | |
| 4,291,610 | A | 9/1981 | Waiser | |
| 4,584,924 | A | 4/1986 | Taguchi | |
| 4,588,043 | A | 5/1986 | Finn | |
| 4,939,977 | A | 7/1990 | Stroup | |
| 5,136,923 | A | 8/1992 | Walsh, Jr. | |
| 5,164,535 | A | 11/1992 | Leasure | |
| 6,575,074 | B1 | 6/2003 | Gaddini | |
| 6,796,214 | B2 | 9/2004 | Hausken et al. | |
| 6,848,538 | B2 | 2/2005 | Shafer | |
| 6,973,863 | B1 | 12/2005 | Jones | |
| 7,207,253 | B2 | 4/2007 | Smolders | |
| 7,412,917 | B2 | 8/2008 | Vais | |
| 8,794,376 | B2 * | 8/2014 | Shults et al. | 181/223 |

* cited by examiner

*Primary Examiner* — Jeremy Luks
(74) *Attorney, Agent, or Firm* — Edell, Shapiro & Finnan LLC

(57) ABSTRACT

A baffle for use in a firearm suppressor to decrease the amount of sound and flash upon the firing of a firearm on which the suppressor is attached. The baffle comprises a hollow cone-shaped main member having a vertex connected to a base by an annular side surface. The base and the vertex are centered at an elongate central axis of the main member and the side surface has a baffle entry aperture extending therethrough. The baffle entry aperture extends along the side surface in the direction of the base and is offset from the elongate central axis of the main member. In use, the cone-shaped main member is located in a non-centered position within the suppressor such that the vertex is offset from a bore extending through the suppressor and the baffle entry aperture is aligned with the bore of the suppressor.

20 Claims, 3 Drawing Sheets

FIREARM SUPPRESSOR BAFFLE

BACKGROUND

1. Field of the Invention

The invention generally relates to firearm sound suppressors and, more particularly, to a baffle for use in a firearm sound suppressor.

2. Related Art

The general purpose of a firearm sound suppressor (silencer) is to reduce the sound that emanates from the firing of a projectile (e.g., bullet) from a firearm to which the sound suppressor is attached. Sound suppressors are typically attached to the end of a firearm barrel, referred to as the muzzle, and operate to reduce the pressure of the propellant gases that immediately follow the projectile out of the muzzle. It is the rush of these propellant gases out of the end of the barrel that causes the loud sound associated with the firing of the firearm. By dissipating this pressure under which the propellant gases escape from the muzzle, the amount of sound which is perceived when the firearm is discharged is significantly reduced. Sound suppressors may also be used to suppress the "flash" which occurs when a projectile is fired from a firearm.

A variety of conventional firearm sound suppressors have been developed. However, certain conventional sound suppressors may result in side effects that adversely affect the operation of the firearm. For example, one problem that results from the use of certain sound suppressors is a loss of power to the fired projectile. This loss in power can detrimentally affect the trajectory of the fired projectile, which in turn affects the accuracy of the firearm to which the suppressor is attached (i.e., the firearm may have a point of impact with the sound suppressor attached that is different from the point of impact when the suppressor is not attached). Furthermore, the structure of some conventional firearm suppressors is delicate so as to limit or prevent the use of the suppressors in various environments.

SUMMARY

In one aspect of the invention, a firearm sound suppressor baffle is provided. The firearm suppressor baffle comprises a hollow conical main member having a vertex connected to a base by an angular side surface, wherein the base and vertex are centered at an elongate axis of the conical main member; a baffle exit aperture disposed in the base of the conical main member; and a baffle entry aperture disposed in the angular side surface so as to be offset from the vertex of the conical main member.

In another aspect of the invention, a firearm sound suppressor is provided. The firearm sound suppressor comprises an external suppressor housing having an elongate central axis; a mounting cap positioned at a proximal end of the suppressor housing; an end cap positioned at a distal end of the suppressor housing; and a plurality of offset conical baffles disposed between the mounting cap and the end cap, wherein the offset conical baffles are each configured direct gases toward the external suppressor housing at an angle relative to the elongate central axis of the suppressor housing.

In a further aspect of the invention, a firearm suppressor baffle is provided. The firearm sound suppressor baffle comprises a hollow cone comprising a vertex connected to a base by an angular side surface, wherein the base and vertex are centered at an elongate axis of the cone; and a baffle entry aperture disposed in the angular side surface of the conical main member so as to direct gases into the cone at an angle relative to the elongate axis of the cone.

BRIEF DESCRIPTION OF THE DRAWINGS

Embodiments of the present invention are described herein in conjunction with the accompanying drawings, in which.

DETAILED DESCRIPTION

Presented herein is a baffle for use in a firearm sound suppressor that is configured to substantially reduce the perceived sound and flash from the discharge of a firearm yet has little or no detrimental impact on the accuracy of the fired projectile. In particular, a suppressor baffle in accordance with embodiments presented herein comprises a hollow conical main member having a vertex connected to a base by an angular side surface. The base and vertex are centered at an elongate axis of the conical main member. The baffle also includes an exit aperture disposed in the base of the conical main member and a bore aperture disposed in the angular side surface of the conical main member. The bore aperture that is offset from the vertex of the conical main member and is contiguous with an elongate slot extending from the bore aperture. The bore aperture and elongate slot are sometimes collectively referred to herein as a baffle entry aperture. In operation, a projectile passes straight through the baffle entry aperture substantially parallel to the elongate axis of the conical main member. However, gases following the projectile pass through the baffle entry aperture at an angle relative to the elongate axis of the conical main member.

Figure 1:
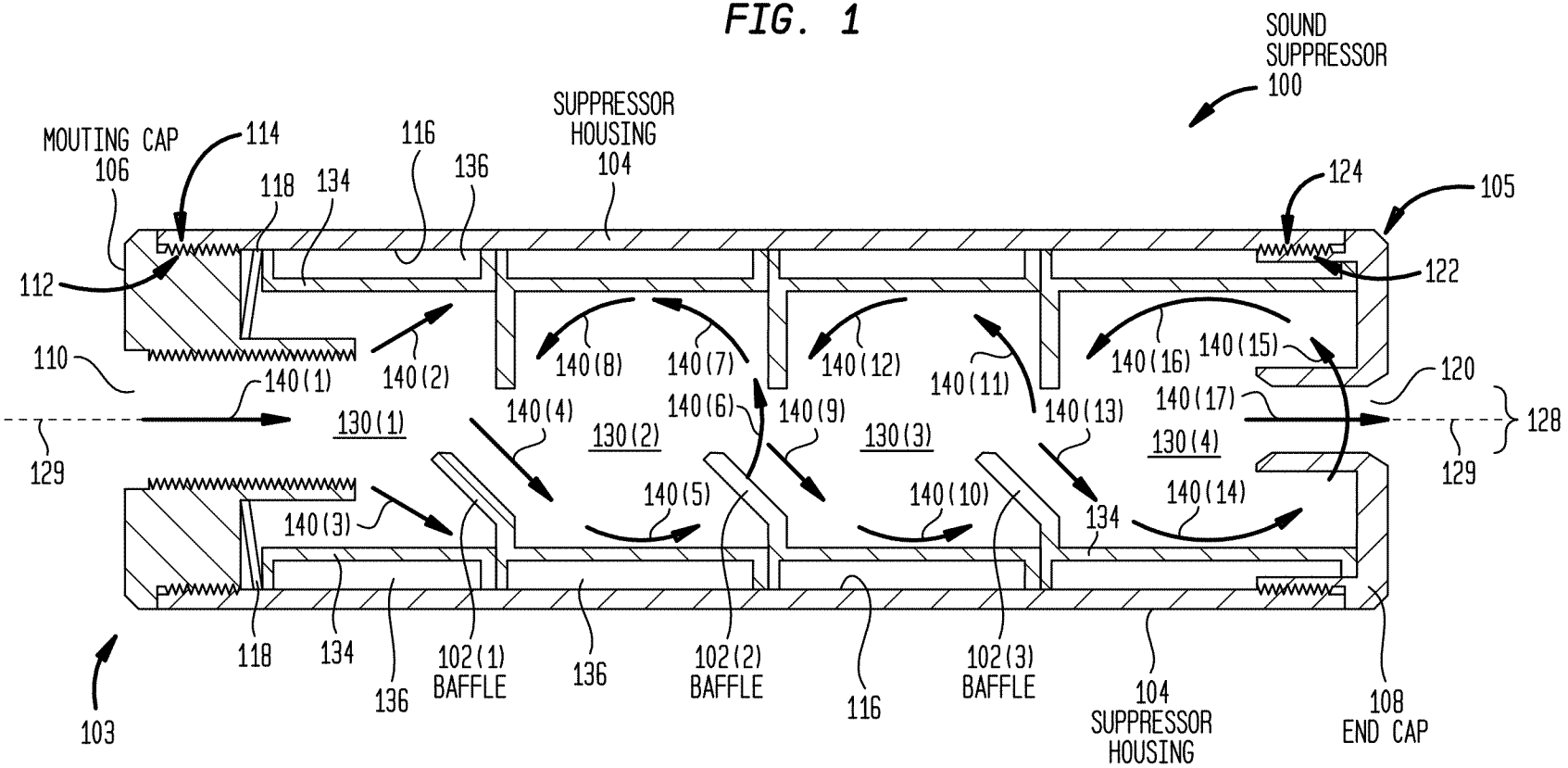
FIG. 1 is a cross-sectional view of a firearm sound suppressor that comprises baffles in accordance with embodiments presented herein.

In practice, a baffle in accordance with embodiments presented herein is positioned within a firearm sound suppressor that is attached to the muzzle of a firearm (not shown). FIG. 1 is a cross-sectional view of a firearm sound suppressor 100 that includes a plurality of baffles in accordance with embodiments presented herein. The cross-sectional view of FIG. 1 is taken along an elongate plane through the center of sound suppressor 100. It is to be appreciated that, for ease of illustration, portions of the sound suppressor 100 disposed on either side of the elongate plane have been omitted from FIG. 1.

The sound suppressor 100 includes three (3) baffles 102(1), 102(2), and 102(3), which are collectively and generally referred to herein as baffles 102. The number of baffles present in a sound suppressor may vary depending on, for example, different firearms, different firearm calibers, etc.

The sound suppressor 100 includes an external (outer) suppressor housing or tubing 104 that has an elongate cylindrical shape. The sound suppressor 100 also comprises a mounting cap 106 that is positioned at a first end (proximal end) of the suppressor housing 104 and an end cap 108 that is positioned at a second end (distal end) of the suppressor housing 104. The mounting cap 106 is a generally annular element having a central aperture 110. An outer portion of the mounting cap 106 includes threads 112 that are configured to mate with threads 114 at an inner surface 116 of the suppressor housing 104. The end cap 108 is also a generally annular element having a central aperture 120. An outer portion of the end cap 108 includes threads 122 that are configured to mate with threads 124 at the inner surface 116 of the suppressor housing 104.

Adjacent to the mounting cap 106 is a belleville disc spring (belleville washer) 118. The belleville disc spring 118 is configured to protect the baffles and prevent compressing or crashing of the suppressor 100 from thermal expansion that is generated during discharge of the firearm.

The sound suppressor 100 may be attached to the muzzle of a firearm in a number of different manners. In the specific example of FIG. 1, the mounting cap 106 includes threads 126 disposed around the central aperture 110. The threads 126 are configured to mate with corresponding threads of the firearm muzzle. It is to be appreciated that the thread connection mechanism of FIG. 1 is merely illustrative. In alternative arrangements, the sound suppressor 100 may include other attachment mechanisms including, for example, a quick-attach system, slotted connections, or any other attachment mechanisms which are known to persons of skill in the art. In general, sound suppressor 100 is attached in such a way so as to provide an elongated path for the projectile through the (1) central aperture 110 of mounting cap 106, (2) the baffles 102, and (3) the central aperture 120 of end cap 108. This elongated path through the sound suppressor 100 (i.e., through the central aperture 110, the baffles 102, and central aperture 120) follows the elongate central axis 129 of the sound suppressor 100 and is sometimes referred to herein as bore 128 of the sound suppressor 100.

As noted above, the sound suppressor 100 includes three (3) baffles 102(1), 102(2), and 102(3) in accordance with embodiments of the present invention. The baffles 102 form four (4) internal expansion chambers within the sound suppressor 100. More specifically, a first expansion chamber 130(1), sometimes referred to as the blasting chamber, is bounded at a proximal end by mounting cap 106 (and more directly belleville disc spring 118) and is bounded at a distal end by baffle 102(1). The second expansion chamber 130(2) is bounded at a proximal end by baffle 102(1) and at a distal end by baffle 102(2). The third expansion chamber 130(3) is bounded at a proximal end by baffle 102(2) and at a distal end by baffle 102(3). Finally, the fourth expansion chamber 130(4) is bounded at a proximal end by baffle 102(3) and at a distal end by end cap 108.

When the firearm (to which sound suppressor 100 is attached) is discharged, a projectile (not shown) exits from the muzzle and traverses the sound suppressor 100 passing through the bore 128. As shown by arrow 140(1), the gases behind the projectile enter the sound suppressor 100 and expand within the first expansion chamber 130(1). The first expansion chamber 130(1) is surrounded by a first section of spacer tubing 134 that extends between the belleville disc spring 118 and the first baffle 102(1).

In the example of FIG. 1, the spacer tubing 134 extends along the elongate length of the sound suppressor 100 in sequential sections so as to surround each of the expansion chambers 130(1), 130(2), 130(3), and 130(4). Each of the sections of spacer tubing 134 are configured to secure the baffles 102 in position (i.e., at certain separation distances) and each are separated from the suppressor housing 104. As such, the sections of the spacer tubing 134 and the suppressor housing 104 form a series of external depressurizing chambers 136. When an expansion chamber 130(1)-130(4) is pressurized by propellant gases, some gas vents through openings (not shown) in the spacer tubing 134 so enter the adjacent depressurizing chamber 136. This relieves some of the pressure so as to decrease perceived sound (i.e., when the pressure goes down, the sound also goes down since sound is pressurized air). The sections of spacer tubing 134 may be connected to (integrated with) a baffle 102, or can be formed as a separate component without affecting the performance of the sound suppressor 100.

It is to be appreciated that the use of depressurizing chambers 136 is merely illustrative and may not be used in all arrangements. For example, some low pressure suppressors do not utilize depressurizing chambers. In such arrangements, the spacer tubing 134 may have the same outside diameter as the baffles 102. It is also to be appreciated that spacer tubing dimensions will vary to, for example, compensate for different firearm calibers. In certain circumstances, the spacer tubing dimensions may vary within the same sound suppressor.

The propellant gases enter the first expansion chamber 130(1) and are partially divided. More specifically, as the gases follow behind the projectile, the gases spread out as generally shown by arrows 140(2) and 140(3). The gases expand rapidly and, when the first expansion chamber 130(1) gets pressurized, some gases move to the adjacent depressurizing chamber 136 via vents (not shown) in the spacer tubing 134. This reduces the pressure and retards gas exit.

A portion of the propellant gases impinge upon and pass through the first baffle 102(1). As described further below, the first baffle 102(1), as well as the other baffles 102(2) and 102(3), have a shape/configuration that causes the gases to be directed at an angle, generally represented by arrow 140(4), towards spacer tubing 134. More specifically, the baffle 102(1) is designed such that the pressurized gases can escape through the baffle 102(1) only in a direction that is angled relative to the bore 128 (i.e., relative to a longitudinal axis of the sound suppressor 100). The angled exit of the pressurized gases from baffle 102(1) causes the gases to reflect from spacer tubing 134 and circulate through the second expansion chamber 130(2). The reflection and circulation of the gases with the second expansion chamber 130(2) is generally shown by arrows 140(5), 140(6), 140(7), and 140(8). The circulation caused by the angled exit of the pressurized gases from baffle 102(1) breaks down the sound by reducing the speed and generating turbulence and thus retarding the exit of the gas. When the second expansion chamber 130(2) becomes pressurized, gases will exit to the surrounding depressurizing chamber 136 (via the connective vents). Reduced pressure gases will then enter the next internal expansion chamber 130(3) via baffle 102(2).

As noted, baffle 102(2) has the same configuration as baffle 102(1). As such, the gases enter expansion chamber 130(3) at an angle so as to circulate in a similar manner as in expansion chamber 130(2). Arrow 140(9) represents the angled entrance of gases into expansion chamber 130(3) and arrows 140(10), 140(11), and 140(12) generally illustrate the circulation of the gases within the expansion chamber 130(3). As is the case with expansion chamber 130(2), when the third expansion chamber 130(3) becomes pressurized, gases will exit to the surrounding depressurizing chamber 136 (via the connective vents). Reduced pressure gases will then enter the next internal expansion chamber 130(4) via baffle 102(3).

Baffle 102(3) has the same configuration as baffles 102(1) and 102(2). As such, the gases enter expansion chamber 130(4) at an angle so as to circulate in a similar manner as in expansion chambers 130(2) and 130(3). Arrow 140(13) represents the angled entrance of gases into expansion chamber 130(4) and arrows 140(14), 140(15), and 140(16) generally illustrate the circulation of the gases within the expansion chamber 130(4). As is the case with expansion chambers 130(2) and 130(3), when the fourth expansion chamber 130 (4) becomes pressurized, gases will exit to the surrounding depressurizing chamber 136 (via the connective vents). As shown by arrow 140(17), reduced pressure gases will then exit the sound suppressor 100 via central aperture 120 of end cap 108.

The process of expanding and reflecting initiated by baffles 102 causes the pressure and velocity of the gases to be divided and redirected. This continues to take place in each expansion chamber until the gases exit the suppressor with a reduced pressure and velocity, which results in a subsequent reduction in the sound level due to the reduced pressure and velocity of the muzzle gases.

FIG. 1 illustrates an example where three (3) baffles are present. In certain examples, between two (2) and five (5) baffles may be utilized to achieve and produce the desired sound suppression. However, the number and dimensions of baffles may be altered depending upon the individual circumstances.

Figure 2:
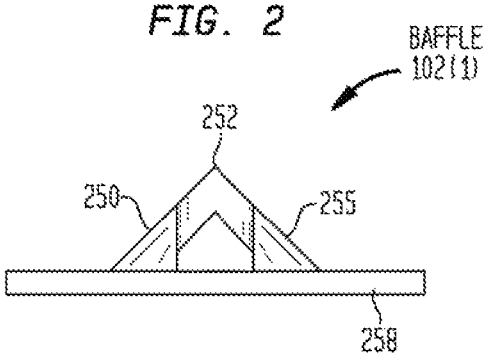
FIGS. 2 and 3 are elevation views of a firearm sound suppressor baffle in accordance with embodiments presented herein.

FIG. 2 is an elevation view of a baffle, such as baffle 102(1), in accordance with embodiments of the present invention. For ease of description, the FIG. 2 will be described with reference to baffle 102(1). It is to be appreciated that the baffles 102(2), 102(3), and other baffles described herein have the same arrangement as baffle 102(1).

In FIG. 2, baffle 102(1) is shown at an angle that is rotated ninety (90) degrees with respect to the cross-sectional view of FIG. 1. That is, if FIG. 1 is referred to as providing a "right-side" cross-sectional view of baffle 102(1), FIG. 2 provides a "top" elevation view of the baffle 102(1). It is to be understood that terms such as "left," "right," "top," "bottom," "front," "rear," "side," "height," "length," "width," "upper," "lower," "interior," "exterior," "inner," "outer," "forward," "rearward" and the like as may be used herein, merely describe points or portions of reference and do not limit embodiments presented herein to any particular orientation or configuration. Furthermore, terms such as "first," "second," "third," etc., merely identify one of a number of portions, components and/or points of reference as disclosed herein, and do not limit the embodiments presented herein to any particular configuration or orientation.

Figure 3:
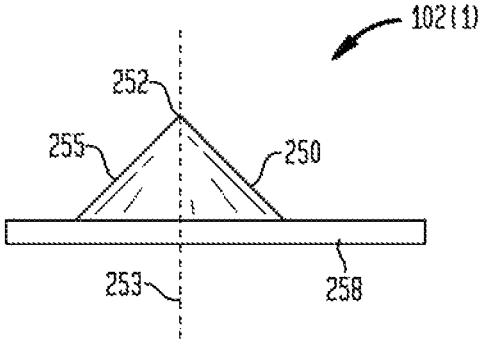
Figure 4:
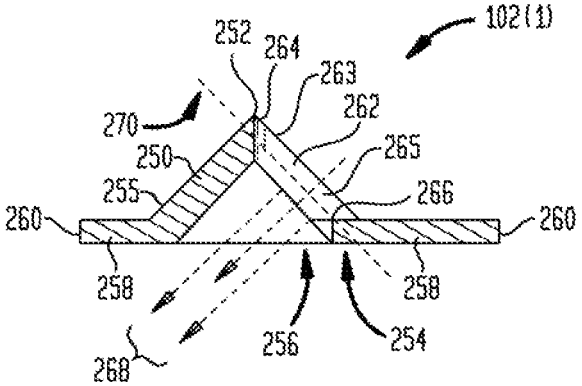
FIGS. 4 and 5 are cross-sectional views of a firearm sound suppressor baffle in accordance with embodiments presented herein.
Figure 5:
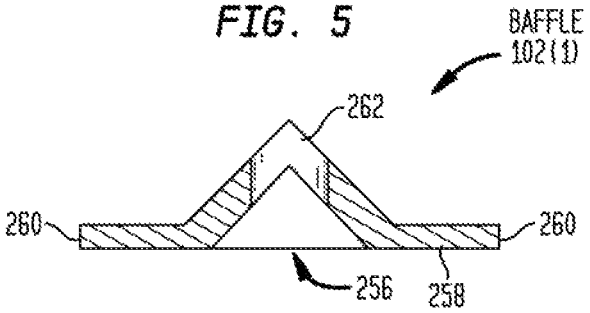

Additionally, FIG. 3 is another elevation view of the baffle 102(1). In this example, the baffle 102(1) is shown at the same angle as in FIG. 1. That is, FIG. 3 is a "right-side" elevation view of the baffle 102(1). FIGS. 4 and 5 are each complete cross-sectional views of the baffle 102(1). FIG. 4 illustrates the baffle 102(1) at the substantially the same angle as in FIG. 1 (i.e., FIG. 4 is a "right-side" cross-sectional view of the baffle 102(1). FIG. 5 illustrates the baffle 102(1) at an angle that is rotated ninety (90) degrees from the cross-sectional view of FIG. 1 (i.e., FIG. 5 is a "top" cross-sectional view of baffle 102(1)). As noted above, some details of sound suppressor 100, including details of baffle 102(1), were omitted from FIG. 1 to facilitate illustration. FIGS. 4 and 5 illustrate the details of baffle 102(1) that were omitted from FIG. 1.

Figure 6:
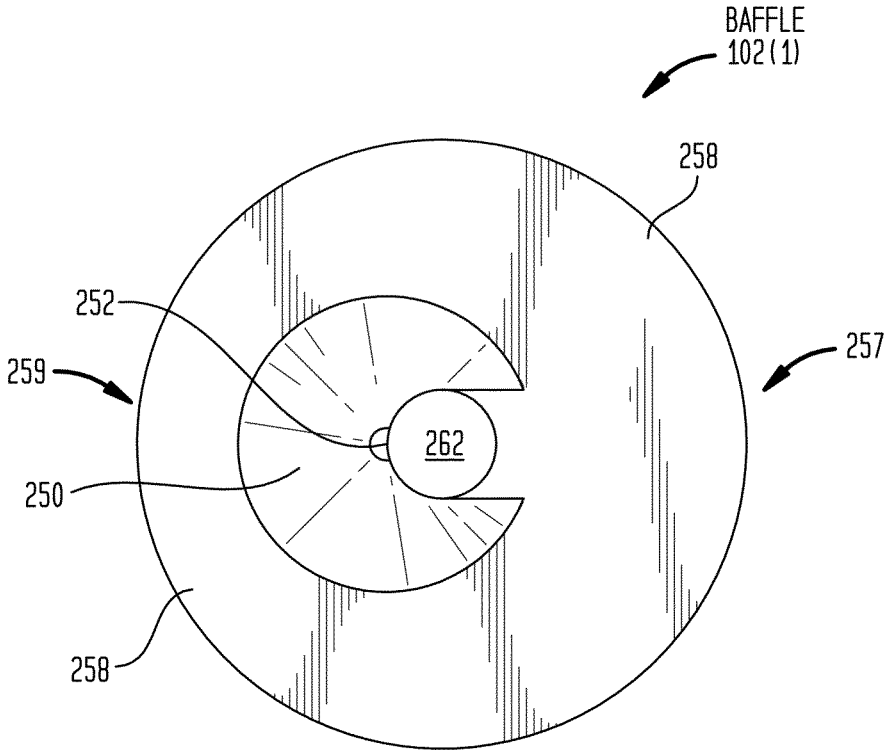
FIG. 6 is another elevation view of a firearm sound suppressor baffle in accordance with embodiments presented herein.

FIG. 6 is an elevation view of baffle 102(1) viewed along the elongate length of sound suppressor 100. That is, in FIG. 6 the baffle 102(1) is viewed from the first end 103 of sound suppressor 100 (i.e., in the direction of travel of a projectile from the firearm muzzle).

Certain features of baffle 102(1) are shown in more than one of FIGS. 2, 3, 4, 5, and 6. For ease of description, FIGS. 2, 3, 4, 5, and 6 are described below together without making specific reference to the specific FIG(s). in which a feature appears.

Baffle 102(1) first includes a substantially hollow conical main member (cone) 250 having a vertex 252 positioned at a central elongate axis 253 of the cone. The conical main member 250 also comprises a base 254 defining a circular aperture 256 also centered at central axis 253. The vertex 252 and base 254 are connected by an angular side surface 255 of the conical main member 250. The vertex 252, base 254, and angular side surface 255 collectively define the conical main member 250. As shown in FIGS. 3 and 4, the vertex 252 of the conical main member (cone) 250 terminates at a point on the central elongate axis 253 of the conical main member (cone) 250 and the angular side surface 255 of the conical main member (cone) 250 is straight (i.e., not curved).

The circular aperture 256 in base 254 is sometimes referred to herein as a baffle exit aperture 256. Extending from base 254 is an annular collar 258. When the baffle 102(1) forms part of a sound suppressor, such as sound suppressor 100, the outer edge 260 of collar 258 is configured to be positioned abutting, for example, the inner surface 116 of suppressor housing 104 so as to block the flow of gases around conical main member 250. The collar 258 includes a portion 257 that is wider than a portion 259 that is on the opposing side of conical main member 250. As such, the collar 258 has an irregular annular shape.

The baffle 102(1) also includes a baffle entry aperture 262. The baffle entry aperture 262 operates as the point where both a projectile and propellant gases enter the hollow region defined by conical main member 250 (i.e., the point where both a projectile and propellant gases enter baffle 102(1)).

The baffle entry aperture 262 can generally be divided into two sections, namely a generally circular bore opening 263 and an elongate slot 265. As shown, the bore opening 263 is offset from the vertex 252. The bore opening 263 lies on, and follows, the angular side surface 255 of the conical main member 250. The elongate slot 265 extends from the bore opening 263 in the direction of the base 254 also along the angular side surface 255. As shown in the cross-sectional view of the baffle (see FIG. 4), the elongate slot 265 terminates at the base 254 of the conical main member (cone) 250. In other words, a line 270 extending across the circumference of bore opening 263 and along the elongate length of elongate slot 265 is positioned at an angle relative to the central axis 253 of the conical main member 250. Also as shown in FIG. 4, the baffle entry aperture 262 has a first side 264 that is offset from the second side 266.

When baffle 102(1) is positioned within sound suppressor 100, the first side 264 of baffle entry aperture 262 lies closer to the direction of travel of a projectile from the firearm muzzle than the second side 266 (i.e., offset in this context means that the first side 264 is closer to the firearm muzzle than is the second side 266). Additionally, since the collar 258 has an irregular annular shape, when baffle 102(1) is positioned within sound suppressor 100, the bore opening 263 (rather than the vertex 252) is aligned with the bore 128 of the sound suppressor 100.

As noted above, both a fired projectile (not shown) and propellant gases 268 enter baffle 102(1) through baffle entry aperture 262. Projectiles travel in a straight line through sound suppressor 100 and pass through bore opening 263 parallel to both side 264 and 266 of the baffle entry aperture 262 (i.e., parallel to central axis 253 of conical main member 250). However, propellant gases 268 do not necessarily travel in a straight line and their general direction can be affected by obstructions. In the case of baffle 102(1), the offset between sides 264 and 266 functions to direct the propellant gases that enter through baffle entry aperture 262 in an angular direction relative to central axis 253. As described above, the directing of the propellant gases 268 causes the gases to circulate within the subsequent expansion chamber thereby reducing pressure and velocity resulting in a subsequent reduction in the sound level.

In the examples presented herein, the conical main member 250 is in a non-centered position within sound suppressor 100 such that the vertex 252 of the cone is on the edge of the bore 128 (aligned with bore opening 263). The entry of pressurized gases into the baffle 102(1) is on the side of the cone, thereby making one side of the baffle entry aperture 262 further up the cone (i.e., higher on the cone) than the other side (i.e., farther down the cone). This may be, for example, cause the entry of the cone to be positioned at a forty-five (45) degree angle relative to central axis 253. Due to the fact that the conical member 250 is not centered in the sound suppressor and that the bore aperture 262 is offset from the vertex 252, the baffle 102(1) is sometimes referred to herein as an offset conical baffle.

In certain embodiments presented herein, the baffles are configured to define chambers that each has a volume between 1.25 to 3 times the volume of the suppressor bore. The number of baffles and the lengths of the expansion chambers may be altered so as to maximize the cancellation of gas pressure within the expansion chambers. In one specific embodiment, the length of the expansion chambers towards the distal end of the sound suppressor. However, in other embodiments of the invention, the expansion chambers may be configured to be substantially uniform. Depending upon the caliber of the firearm upon which a sound suppressor is attached, the gas pressure characteristics of the firearm, characteristics of the round being fired, etc., the dimensions, number, and/or spacing of baffles may vary considerably.

The invention described and claimed herein is not to be limited in scope by the specific embodiments herein disclosed, since these embodiments are intended as illustrations, and not limitations, of several aspects of the invention. Any equivalent embodiments are intended to be within the scope of this invention. Indeed, various modifications of the invention in addition to those shown and described herein will become apparent to those skilled in the art from the foregoing description. Such modifications are also intended to fall within the scope of the appended claims.

What is claimed is:

1. A firearm suppressor baffle, comprising:

a hollow cone-shaped main member including:

a vertex which terminates at a point on a central elongate axis of the cone-shaped main member;

a base defining a circular baffle exit aperture; and an angular non-curved side surface connecting the vertex to the base, said side surface having a baffle entry aperture disposed therethrough;

wherein the vertex and the circular exit aperture are centered at the central elongate axis of the cone-shaped main member, and wherein the baffle entry aperture comprises a bore opening and an elongate slot in the angular side surface, said bore opening and said elongate slot each being laterally offset from the central elongate axis of the cone-shaped main member.

2. The baffle of claim 1, wherein the bore opening has a circumference and a line taken across the circumference of the bore opening is angled relative to the central elongate axis of the cone-shaped main member.

3. The baffle of claim 1, wherein the baffle entry aperture is defined by first and second offset sides, the first side of the baffle entry aperture being higher up the angular side surface of the cone-shaped main member than the second side of the baffle entry aperture.

4. The baffle of claim 3, when positioned in a firearm sound suppressor, the first side of the baffle entry aperture is closer to a direction of travel of a projectile from a firearm muzzle to which the firearm sound suppressor is attached.

5. The baffle of claim 1, when positioned in a firearm sound suppressor, the baffle is configured such that a projectile passes straight through the baffle entry aperture substantially parallel to the central elongate axis of the cone-shaped main member and gases following the projectile pass through the baffle entry aperture at an angle relative to the central elongate axis of the cone-shaped main member.

6. The baffle of claim 1, further comprising:

an annular collar extending from the base of the cone-shaped main member around the circular baffle exit aperture.

7. The baffle of claim 6, wherein the annular collar has a portion on one side of the cone-shaped main member that is wider than a portion on an opposing side of the cone-shaped main member such that the annular collar has an irregular annular shape.

8. The baffle of claim 1, wherein the baffle is configured to be positioned within a generally hollow suppressor body so as to define a first expansion area between the baffle and a mounting cap.

9. The baffle of claim 1, wherein the base defines a circular baffle exit aperture, and the elongate slot extends from the bore opening along the angular side surface and terminates at the base exit aperture.

10. A firearm sound suppressor, comprising:

an external suppressor housing defining an elongate bore having an elongate central housing axis;

a mounting cap positioned at a proximal end of the suppressor housing, said mounting cap having a central aperture concentric with the elongate bore;

an end cap positioned at a distal end of the suppressor housing, said end cap having a central aperture concentric with the elongate bore; and a plurality of baffles disposed within the suppressor housing between the mounting cap and the end cap, each of said baffles including a hollow conical main member having a central elongate baffle axis extending through a vertex of the conical main member and an angular side surface having a bore opening offset from the central elongate baffle axis, wherein the central elongate baffle axes of the conical main members are coaxial and laterally offset from the elongate central housing axis, wherein the bore openings in the side surface of the conical main members are coaxial and axially aligned with the elongate central housing axis, and wherein each conical main member is configured to direct gases toward the external suppressor housing at an angle relative to the elongate central axis of the suppressor housing.

11. The firearm sound suppressor of claim 10, wherein each conical main member is configured to direct gases at an approximately forty-five degree angle relative to the elongate central axis of the suppressor housing.

12. A firearm sound suppressor, comprising:

an external suppressor housing having an elongate central axis;

a mounting cap positioned at a proximal end of the suppressor housing;

an end cap positioned at a distal end of the suppressor housing; and a plurality of offset conical baffles disposed between the mounting cap and the end cap, wherein the offset conical baffles are each configured to direct gases toward the external suppressor housing at an angle relative to the elongate central axis of the suppressor housing, wherein each offset conical baffle comprises:

a hollow conical main member having a vertex connected to a base by an angular side surface, wherein the base and vertex are centered at an elongate axis of the conical main member;

a baffle exit aperture disposed in the base of the conical main member;

a bore opening disposed in the angular side surface so as to be offset from the vertex of the conical main member; and an elongate slot extending from the bore opening along the angular side surface in the direction of the base.

13. The firearm sound suppressor of claim 12, wherein the bore opening includes a first end adjacent to the vertex of the conical main member, and the elongate slot includes a second end, and wherein the first end is offset from the second end so as to be positioned closer to the mounting cap of than the second side of the bore aperture.

14. The firearm sound suppressor of claim 12, wherein each baffle further comprises an annular collar having an irregular shape extending from the base of the conical main member so as to block the flow of gases around the baffle, wherein the irregular shape of the annular collar causes the vertex of the conical main member to be offset from the elongate central axis of the suppressor housing.

15. The firearm sound suppressor of claim 10, further comprising:

a belleville spring positioned abutting the mounting cap.

16. A firearm suppressor baffle for use in a firearm sound suppressor, said sound suppressor including an outer housing defining a bore having an elongate central housing axis extending from a central aperture in a mounting cap positioned at a proximal end of the housing to a central aperture in an end cap positioned at a distal end of the housing, said baffle comprising:

a hollow cone comprising a vertex connected to a base by a straight side surface situated at an angle to the base, wherein the base and vertex are centered at a central elongate axis of the cone and the vertex terminates at a point on the central elongate axis of the cone; and a baffle entry aperture extending through the straight side surface of the cone so as to direct gases into the cone at an angle relative to the central elongate axis of the cone, wherein said baffle entry aperture is offset from the central elongate axis of the cone and extends along the straight side surface in the direction of the base, and wherein, when the baffle is positioned within the suppressor housing, the vertex and the central elongate axis of the cone are offset from the elongate central housing axis and the baffle entry aperture is in alignment with the elongate central housing axis.

17. The firearm suppressor baffle of claim 16, wherein the baffle entry aperture is configured to direct gases at an approximately forty-five degree angle relative to the central elongate axis of the cone.

18. The baffle of claim 16, wherein the baffle entry aperture comprises a bore opening and an elongate slot extending from the bore opening in the direction of the base.

19. The baffle of claim 18, wherein the bore opening has a circumference and a line extending across the circumference of the bore opening and along the elongate slot is angled relative to the central elongate axis of the cone.

20. The baffle of claim 18, further comprising:

an annular collar extending from the base of the cone, wherein said collar has a portion on one side of the cone that is wider than a portion on an opposing side of the cone such that the annular collar has an irregular shape, and wherein, when the baffle is positioned within the suppressor housing, an outer edge of said irregular shaped collar abuts an inner surface of the suppressor housing such that the bore opening of the baffle is aligned with the suppressor housing bore and the vertex of the cone is situated in a non-centered position within the suppressor housing adjacent the suppressor housing bore.

* * * * *